United States Patent [19]

Schleyer et al.

[11] 4,333,308

[45] Jun. 8, 1982

[54] FALSE-TWIST SYSTEM SWITCHABLE BETWEEN S-TWIST AND Z-TWIST

[75] Inventors: Herbert Schleyer, Schweinfurt; Theo Bieber, Hammelburg, both of Fed. Rep. of Germany

[73] Assignee: Fag Kugelfischer Georg Schäfer & Co., Schweinfurt, Fed. Rep. of Germany

[21] Appl. No.: 200,552

[22] Filed: Oct. 24, 1980

[30] Foreign Application Priority Data

Oct. 26, 1979 [DE] Fed. Rep. of Germany ..... 2943179

[51] Int. Cl.[3] ..... D01H 7/92; D02G 1/04

[52] U.S. Cl. ..... 57/339

[58] Field of Search ..... 57/334, 337, 338, 339

[56] References Cited

U.S. PATENT DOCUMENTS

| | | | |
|---|---|---|---|
| 3,932,985 | 1/1976 | Naylor | 57/339 |
| 4,060,967 | 12/1977 | Lorenz | 57/339 X |
| 4,110,962 | 9/1978 | Schuster et al. | 57/339 |
| 4,115,987 | 9/1978 | Taniguchi et al. | 57/339 |
| 4,124,974 | 11/1978 | Taylor | 57/339 |

FOREIGN PATENT DOCUMENTS

| | | |
|---|---|---|
| 2310802 | 3/1973 | Fed. Rep. of Germany . |
| 2213147 | 3/1974 | Fed. Rep. of Germany . |
| 7434582 | 2/1975 | Fed. Rep. of Germany . |

*Primary Examiner*—Donald Watkins
*Attorney, Agent, or Firm*—Karl F. Ross

[57] ABSTRACT

A false-twist apparatus has a base defining a fixed axis on which is journaled a fixed disk assembly including a shaft and a plurality of disks journaled in the base with the shaft at the fixed axis and the disks spaced therealong. A pair of supports are pivotal on this base and define respective movable axes offset from their pivot axes. Journaled on each of these supports at the respective movable axis is a movable disk assembly including a shaft and a plurality of disks, the shaft lying on the respective movable axis and the disks being spaced therealong. The supports can be pivoted between inner positions with the disks overlapping and each assembly axis equispaced from the other two assembly axes and outer positions with the disk spaced radially. These supports can be secured in the inner positions for false-twisting of a filament passing axially up between the disks. The disks assemblies on the supports are constructed so that they can be switched with each other for converting between S-twist and Z-twist.

6 Claims, 5 Drawing Figures

FALSE-TWIST SYSTEM SWITCHABLE BETWEEN S-TWIST AND Z-TWIST

FIELD OF THE INVENTION

The present invention relates to a false-twist apparatus and a method of operating same. More particularly this invention concerns a false-twist system switchable between S-twist and Z-twist.

BACKGROUND OF THE INVENTION

A false-twist apparatus, as for example described in commonly owned U.S. Pat. No. 4,226,080 or in copending U.S. application Ser. No. 182,649, filed Aug. 29, 1981 has a support which defines three generally parallel and radially spaced axes which surround a central axially extending twisting region. Respective shafts lie on these axes and are journaled in the support for rotation about the respective axes. Respective axially staggered sets of axially spaced disks are fixed on the shafts with the disk rims normally radially overlapped at the twisting regions. A pair of yarn eyes axially flank the disks and are axially aligned with the twisting region so that a yarn to be false-twisted can pass axially through one of the eyes, then zig-zag along the region in contact with the disks, and then pass axially through the other eye. The shafts and the respective disks are all jointly rotated in the same direction, in one direction for S-twisting the yarn and in the opposite direction for Z-twisting the yarn.

Switching between S-twist and Z-twist is not a simple matter of reversing rotation direction for the disks assemblies each constituted by a shaft and the respective disks. It is also necessary when switching between S-twist and Z-twist to change the order of the disks, so that the helix along which the yarn passes as it zigzags through the twisting region will also be reversed. Thus it has been suggested in German printed patent application No. 2,213,147 to mount the disks releasably on the respective shafts. Thus in order to switch the S-twist and Z-twist all of the disks must be removed from the respective shafts and the disks from one shaft switched with the disk of another shaft. Since in a typical texturing installation 200 such false-twist devices may be provided, this represents an enormous amount of work. In fact a machine can be down for a day or more for switching between S-twist and Z-twist.

German utility model No. 7,434,582 shows another arrangement wherein these assemblies can be moved relatively easily from their respective shafts so that they can be switched around for converting from S-twist and Z-twist. With such an arrangement it is therefore necessary to loosen three screws and then removed all three of the disk assemblies so that two of them can be switched with each other. Such an operation is also relatively laborious.

It is also been suggested in German published patent application No. 2,310,802 of W. J. Morris and D. L. McNeight to provide an arrangement wherein one of the disk assemblies can be moved from mesh with one side of the other two disk assemblies to the other side of these assemblies, thereby moving over the twisting region. Such an arrangement therefore requires a relatively complex drive system for the two fixed disk assemblies and the one movable disk assembly, as well as complex bearing structure. What is more, the conversion between these different types of twist also moves the twisting regions so that the guide eyes must be appropriately repositioned.

OBJECTS OF THE INVENTION

It is therefore an object of the present invention to provide an improved convertible false-twisting machine.

Another object is to provide an improved such machine and method of switching same between S-twist and Z-twist.

SUMMARY OF THE INVENTION

These objects are attained according to the instant invention in a false-twist apparatus having a base defining a fixed assembly axis and carrying a fixed disk assembly including a shaft and a plurality of disks that are journaled in the base at the fixed axis with the shaft on the fixed axis and the disks spaced therealong. A pair of supports is provided on this base and defines respective movable assembly axes. Respective movable disk assemblies each including a shaft and a plurality of disks are journaled on the supports with their shafts on the respective movable axes and their disks spaced therealong. Pivot means is provided between the base and the supports for pivoting of these supports about pivot axes offset from the movable axes between inner positions with the disks overlapping and each assembly axis equispaced from the other two assembly axes and outer positions with the disks spaced radially apart. The movable disk assemblies are releasably secured in their supports in such a manner that either of the movable disks assemblies can be mounted in either support so that for changeover between S-twist and Z-twist the movable disk assemblies can be switched. After such switching the drive means connected to the assemblies which jointly rotates all of the assemblies in one direction can be reversed for joint rotation of all the assemblies in the opposite direction.

Thus with the system according to the instant invention it is possible to switch from S-twist to Z-twist simply by displacing the two movable axes away from the third axis until the disks of these axes no longer overlap the disks of the assembly of the third axis. The disk assemblies are then switched and the two axes are displaced back toward the third axis until each assembly axis is radially equispaced from the other two assembly axes and the disks overlap. Then the rotation direction of the assemblies is reversed.

Thus the system according to the instant invention does not require all of the disk assemblies to be painstakingly disassemblied. Only two of the disk assemblies need be switched with one another after pivoting into the outer position. This outward pivoting also makes it relatively easy to clear a blockage of the assembly or to thread a new filament through the assembly, although the loading device described in above-cited U.S. Pat. No. 4,226,080 can be used for this purpose.

According to further feature of this invention, the supports can also be identical, so that it is a possible to switch the two supports with the disk assemblies if desired to changeover between S-twist and Z-twist. The disk assemblies according to the instant invention each have, as described above, a shaft and a plurality of disks. The disks are separate and are normally each provided on one side with a short upstanding collar, and are separated from each other by short sleeves. The distance between two adjacent disks of a single assembly is equal to slightly more than twice the axial height of a single disk, and the sleeves and collars are each slightly thicker than a single disk. Thus it is possible for the assemblies to be interleaved in the appropriate manner so that the filament being false-twisted will follow the desired helix.

SPECIFIC DESCRIPTION

Figure 1:
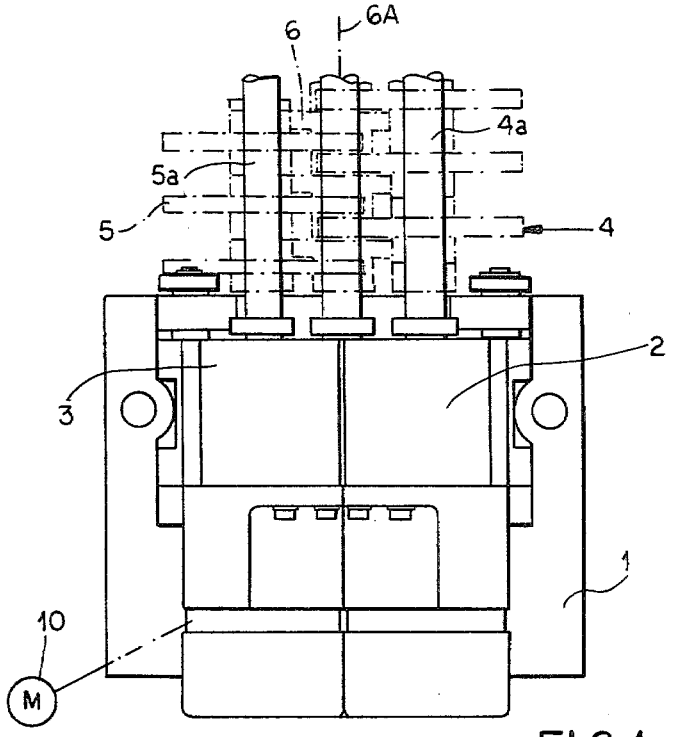
FIG. 1 is a side view of a false-twist apparatus according to this invention.
Figure 2:
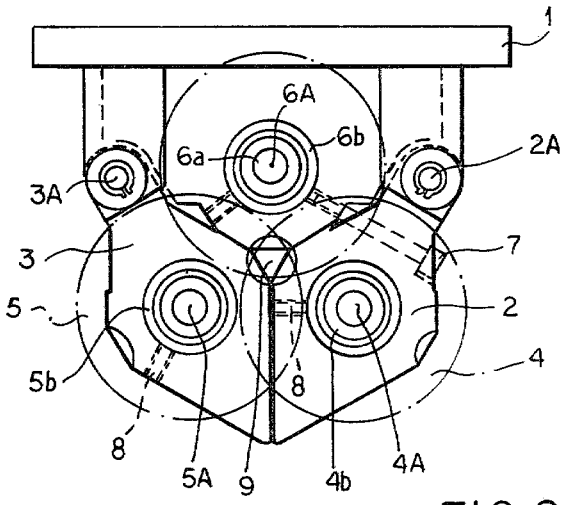
FIG. 2 is a top view of the apparatus of FIG. 1.

As seen in FIGS. 1 and 2 a false-twist apparatus according to the instant invention has a fixed base 1 defining a fixed pivot axis 6A and carrying a pair of supports 2 and 3 pivotal about respective axes 2A and 3A and defining respective movable pivot axes 4A and 5A. Carried at these axes 4A, 5A and 6A are respective disk assemblies 4, 5 and 6 having respective shafts 4*a*, 5*a* and 6*a* journaled by respective bearings 4*b*, 5*b* and 6*b* in the supports 2 and 3 and base 1 for rotation about the respective axes 4A, 5A and 6A.

Figure 5:
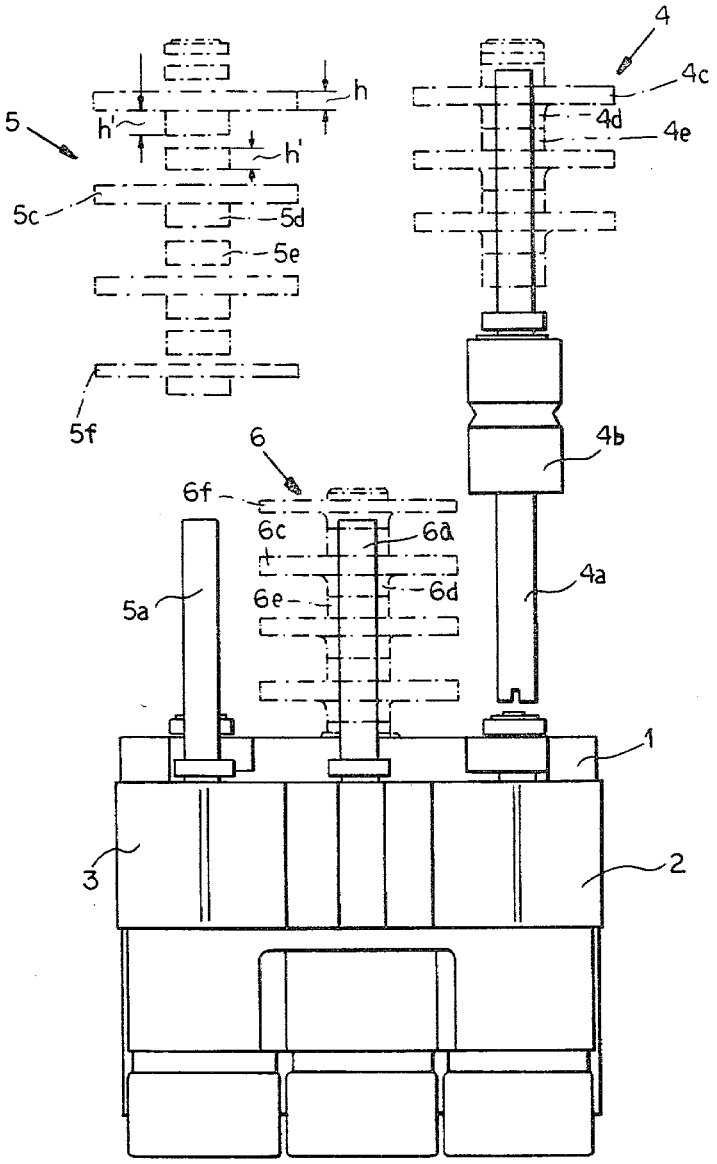
FIG. 5 is a side view corresponding the position of FIG. 4 showing how the disk assemblies are switched with each other.

As seen in FIG. 5 the assembly 5 comprises a stack of disks 5*c* each having a collar 5*d* and a plurality of short sleeves 5*e*. Each of the disks 5*c* has an axial height h which is slightly shorter than the axial height h' of the collars 5*d* and sleeves 5*e*. Thus, when one such sleeve 5*e* is sandwiched between two disks 5*c* with one of the collars 5*d*, sufficient space is left between these two adjacent disks 5*c* to accommodate two similar disks 4*c* and 6*c*. In addition each of the assemblies 5 and 6 has, in addition to the respective disks 5*c* and 6*c*, collars 5*d* and 6*d*, and sleeves 5*e* and 6*e*, end disks 5*f* and 6*f* which are approximately half as high as the other disks, these disks 5*f* and 6*f* being the top and bottom disks of the arrangement.

The bearings 4*b* and 5*b* are releasably received within the respective supports 2 and 3 and held in place therein by means of simple setscrews 8.

The supports 2 and 3 in the inner use position shown in FIG. 2 are secured on the base 1 by means of screws 7 so that the axes 4A, 5A and 6A lie on an equilateral triangle, that is each axis is equispaced from the other two axes and the axes are all parallel. In this position the disks 4*c*, 5*c* and 6*c* interdigitate as shown in FIG. 1. A filament passing upwardly through the twisting region 9 defined by the assemblies 4–6 will therefore be false-twisted in the manner well known per se. To this end the lower ends of the shafts 4*a*–6*a* are engaged by an appropriate drive means such as the motor 10 shown schematically in FIG. 1. Normally a frictional belt drive is employed.

Figure 3:
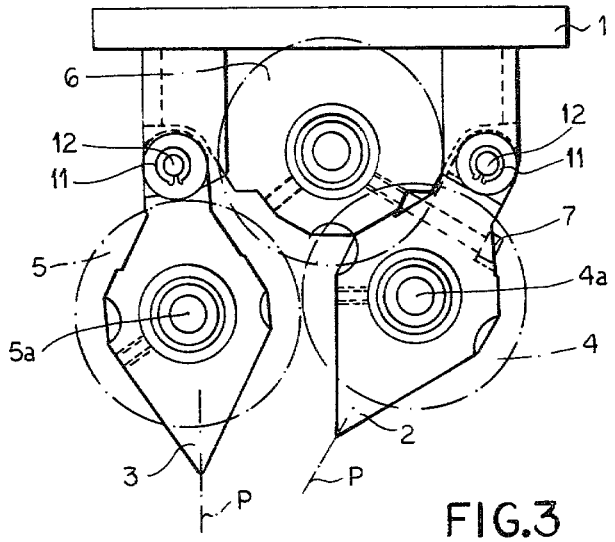
FIGS. 3 and 4 are views similar to FIG. 2 but showing the apparatus as it is opened up to switch the disk assemblies.
Figure 4:
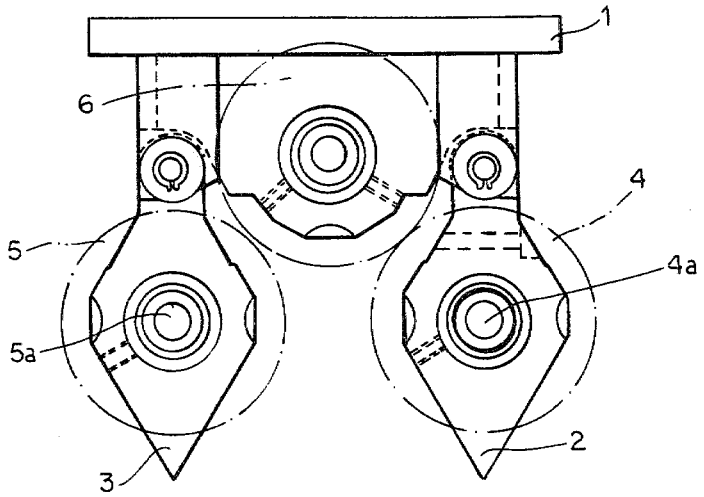

In order to switch between S-twist and Z-twist the screws 7 and 8 are loosened so that the two supports 2 and 3 can be pivoted through the position of FIG. 3 to the position of FIG. 4. In the FIG. 4 position the assemblies 4 and 5 can be lifted upwardly out of the supports 2 and 3 and switched, with the assembly 4 being inserted in the support 3 and the assembly 5 in the support 2. It is also possible to undo the snap rings 11 on the shafts 12 forming the pivot axes 2A and 3A and switch the supports 2 and 3 with the respective assemblies 4 and 5. To this end these supports 2 and 3 are identical and substantially symmetrical along planes P which include their axes.

FIG. 5 indicates how it is possible to relatively easily disassemble the assembly 5, which is substantially identical to the assemblies 4 and 6. Thus replacing any worn parts, including a bearing, is a relatively easily task.

We claim:

1. A false-twist apparatus comprising:

a base defining a fixed assembly axis;

a fixed disk assembly including a shaft and a plurality of disks journaled in said base at said fixed axis with said shaft on said fixed axis and said disks spaced therealong;

a pair of supports on said base defining respective movable assembly axes;

respective movable disk assemblies each including a shaft and a plurality of disks journaled on said supports with said shafts on the respective movable axes and said disks spaced therealong;

respective pivot means between said base and said supports defining respective pivot axes offset from said movable axes for pivoting of said supports with the respective disk assemblies between inner positions with said disks overlapping radially and each assembly axis equispaced from the other two assembly axes and outer positions with said disks spaced radially apart;

drive means connected to said assemblies for jointly rotating said assemblies in one direction about the respective movable and fixed axes for S-twist and in the opposite direction for Z-twist; and means releasably securing said movable disk assemblies in said supports for mounting of either of said movable disk assemblies in either support, whereby for changeover between S-twist and Z-twist said movable disk assemblies can be switched.

2. The apparatus defined in claim 1 wherein each of said movable assemblies further includes a bearing and a drive formation, said bearings lying between the respective drive formations and the respective disks.

3. The apparatus defined in claim 1 wherein said supports are identical.

4. The apparatus defined in claim 1 wherein said disks are releasably mounted on the respective shafts.

5. The apparatus defined in claim 1, further comprising means engageable between said supports and said base for securely retaining said supports in said inner positions.

6. A method of switching from S-twist to Z-twist a false-twist apparatus having support structure defining three generally parallel axes each radially equispaced from the other two axes, respective disk assemblies on said axes and each having a shaft on the respective axis and a plurality of disks spaced axially therealong, the disks of each assembly being axially offset from the disks of the other two assemblies and normally axially overlapping same, and drive means for jointly rotating said assemblies about the respective axes in one direction for S-twist, said method comprising the steps of:

displacing two of said axes away from the third axis until the disks of said two axes no longer overlap the disks of the assembly of the third axis;

thereafter switching the disk assemblies of said two axes with each other;

displacing said two axes and respective assemblies back toward the third axis until said axes are again each radially equispaced from the other two axes and said disks overlap; and reversing the rotation direction of said assemblies.

* * * * *